US006884049B2

(12) United States Patent
Hida et al.

(10) Patent No.: US 6,884,049 B2
(45) Date of Patent: Apr. 26, 2005

(54) SCREW COMPRESSOR AND METHOD OF MANUFACTURING ROTOR FOR THE SAME

(75) Inventors: Takeshi Hida, Shimizu (JP); Masayuki Urashin, Shimizu (JP); Shigekazu Nozawa, Shimizu (JP); Hiroki Ohsumimoto, Shimizu (JP); Hirotaka Kameya, Tsuchiura (JP); Atsushi Watanabe, Chiyoda (JP)

(73) Assignee: Hitachi, Ltd.,, Tokyo (JP); trustee, for the benefit of Hitachi Air Conditioning Systems Co., Ltd.

( * ) Notice: Subject to any disclaimer, the term of this patent is extended or adjusted under 35 U.S.C. 154(b) by 35 days.

(21) Appl. No.: 10/299,683

(22) Filed: Nov. 20, 2002

(65) Prior Publication Data

US 2003/0108446 A1 Jun. 12, 2003

(30) Foreign Application Priority Data

Dec. 12, 2001 (JP) ..... 2001-378010

(51) Int. Cl.[7] ..... F01C 21/00

(52) U.S. Cl. ..... 418/178; 418/179; 418/201.1; 148/230; 148/232

(58) Field of Search ..... 418/178, 179, 418/201.1; 29/888.023; 148/230, 232

(56) References Cited

U.S. PATENT DOCUMENTS

| | | | | | |
|---|---|---|---|---|---|
| 2,538,239 | A | * | 1/1951 | Farnsworth | 148/229 |
| 3,647,577 | A | * | 3/1972 | Nobuyasu | 148/575 |
| 4,000,011 | A | * | 12/1976 | Sato et al. | 418/178 |
| 4,944,663 | A | * | 7/1990 | Iizuka et al. | 418/178 |
| 5,743,321 | A | * | 4/1998 | Joern et al. | 164/44 |

FOREIGN PATENT DOCUMENTS

| | | | | | |
|---|---|---|---|---|---|
| JP | 02107721 | A | * | 4/1990 | C21D/9/32 |
| JP | 02108885 | A | * | 4/1990 | F04C/18/16 |
| JP | 03290086 | A | * | 12/1991 | F04C/18/16 |
| JP | 04048028 | A | * | 2/1992 | C21D/5/00 |
| JP | 09112469 | A | * | 5/1997 | F04C/18/356 |
| JP | A-11-62860 | | | 3/1999 | |

* cited by examiner

*Primary Examiner*—Theresa Trieu
(74) *Attorney, Agent, or Firm*—Antonelli, Terry, Stout & Kraus, LLP

(57) ABSTRACT

A screw compressor of which a female rotor is driven by a motor, and of which a male rotor is driven by the female rotor. The male or female rotor is composed of a member which is made of cast iron and is subjected to surface hardening treatment or heat treatment including quenching. The surface hardening treatment may include sulphonitriding or nitiriding treatment. In the case of subjecting the cast iron to the heat treatment, austemper treatment is applied.

6 Claims, 2 Drawing Sheets

SCREW COMPRESSOR AND METHOD OF MANUFACTURING ROTOR FOR THE SAME

BACKGROUND OF THE INVENTION

The present invention relates to a screw compressor and a method of manufacturing a rotor for the screw compressor, and particularly to an oil-cooled screw compressor with no timing gear, of which performance is improved while ensuring reliability of a tooth surface of the rotor.

In a conventional oil-cooled screw compressor, it is general to connect a male rotor to a shaft of a drive motor directly or via a coupling so that the male rotor operates as a driving shaft to rotate a female rotor. Also, in order to construct the male and female rotors, the number of teeth of the male rotor is smaller than that of the female rotor in view of a geometrical aspect. Further, cast metal such as ductile iron are machined to be used as a material for the rotors.

BRIEF SUMMARY OF THE INVENTION

In the prior art, because rotational speed of the male rotor is fixed and the number of teeth of the male rotor is smaller than that of the female rotor, peripheral velocity of the female rotor is slow and thus, there are problems that leak is relatively increased and performance is degraded. On the contrary, when using the female rotor as a driving shaft, the peripheral velocity can be increased, so that the leak is decreased. Such examples is are disclosed in JP-A-11-62860 or the like.

However, it has been found that, if the cast metal is used as rotor material and the male rotor is driven by the female rotor, strength is not enough to support load exerted on a drive surface of the female rotor, so that there is a problem of causing damage, such as pitching and scoring, on a tooth surface.

Accordingly, it is an object of the present invention to provide a screw compressor which can improve performance of the compressor by decreasing the leak, and also can ensure reliability of rotor tooth surfaces.

In order to achieve the above described object, according to a first feature of the present invention, there is provided a screw compressor including: at least one pair of male and female rotors engaging with each other; a bearing member supporting the rotors; a motor for driving the rotors; and a casing member for housing these elements, namely the male and female rotors, the bearing member and the motor, in which the above described female rotor is driven by the above described motor so that the above described male rotor is driven by the female rotor, and at least one of the above described male and female rotors is composed of a member which is made of cast iron and is subjected to surface hardening treatment.

In this case, the above described surface hardening treatment may be carried out with sulphonitriding or nitiriding treatment, preferably.

According to a second feature of the present invention, there is provided a screw compressor including: at least one pair of male and female rotors engaging with each other; a bearing member supporting the rotors; a motor for driving the rotors; and a casing member accommodating the rotors, the bearing member and the motor, in which the motor drives the female rotor, so that the male rotor is driven by the female rotor, and at least one of said male and female rotors is composed of a member which is made of cast iron and is subjected to heat treatment including quenching, instead of the above described surface hardening treatment. Preferably, the heat treatment is austemper treatment.

According to a third feature of the present invention, there is provided a screw compressor including: a male rotor; a female rotor engaging with the male rotor and having a larger number of teeth than the above described male rotor; a bearing member supporting the male and female rotors; a motor for driving the above described rotors; and a casing member for housing these elements, in which the above described female rotor is driven by the above described motor and the above described male rotor is driven by the female rotor, and the above described male and female rotors are composed of a member which is made of cast iron and is subjected to quenching treatment in a liquid having a temperature of 200 to 450° C.

It is now preferable that the above described liquid for the heat treatment is kept at a temperature of 200 to 270° C. and is a salt bath including salt. Particularly, it is more preferable that the above described cast iron is heated to a temperature of 800 to 900° C. in a no-oxygen atmosphere and hot-quenched in the salt bath having a temperature of 200 to 270° C.

According to a forth feature of the present invention, there is provided a method of manufacturing a rotor for a screw compressor in which a female rotor having a larger number of teeth than a male rotor is driven by a motor and the above described male rotor is driven by the above described female rotor, which method includes the steps of: making the rotor of ductile iron; heating the rotor; subjecting the rotor to quenching treatment in a salt bath of a temperature of 200 to 450° C.; and then holding the rotor in the salt bath at a temperature of 200 to 450° C. for 5 to 240 minutes.

It is more preferable that the above described rotor made of nodular graphite cast iron, namely, made of ductile iron, is heated to a temperature of 800 to 900° C. in a no-oxygen atmosphere, and the rotor is kept, after the quenching, at a temperature of 200 to 270° C. for 5 to 30 minutes, thereafter the rotor is flushed.

Other objects, features and advantages of the invention will become apparent from the following description of the embodiments of the invention taken in conjunction with the accompanying drawings.

DETAILED DESCRIPTION OF THE INVENTION

An embodiment of the present invention will now be described with reference to the drawings.

Figure 1:
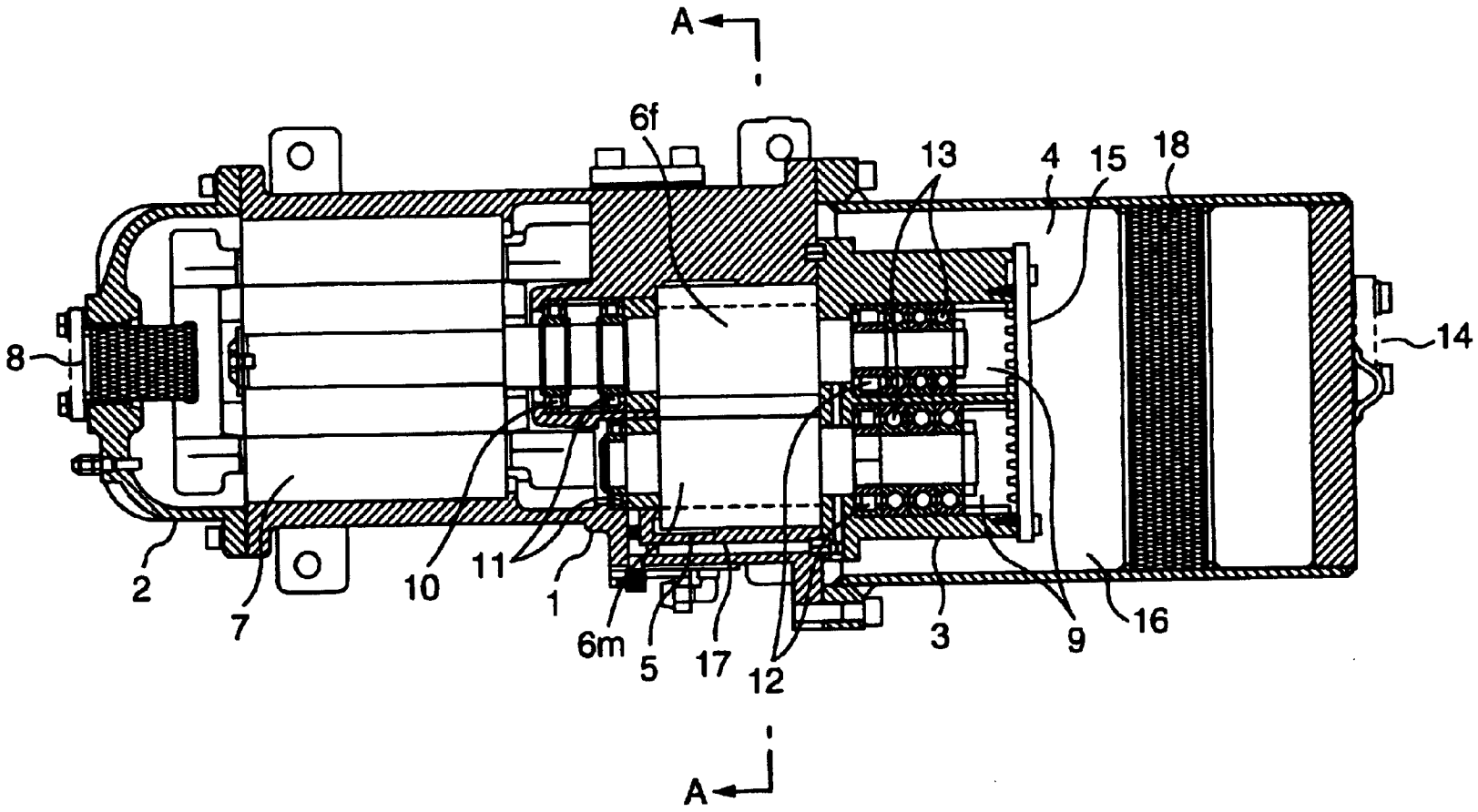
FIG. 1 is a vertical cross sectional view of a screw compressor of an embodiment according to the present invention.
Figure 2:
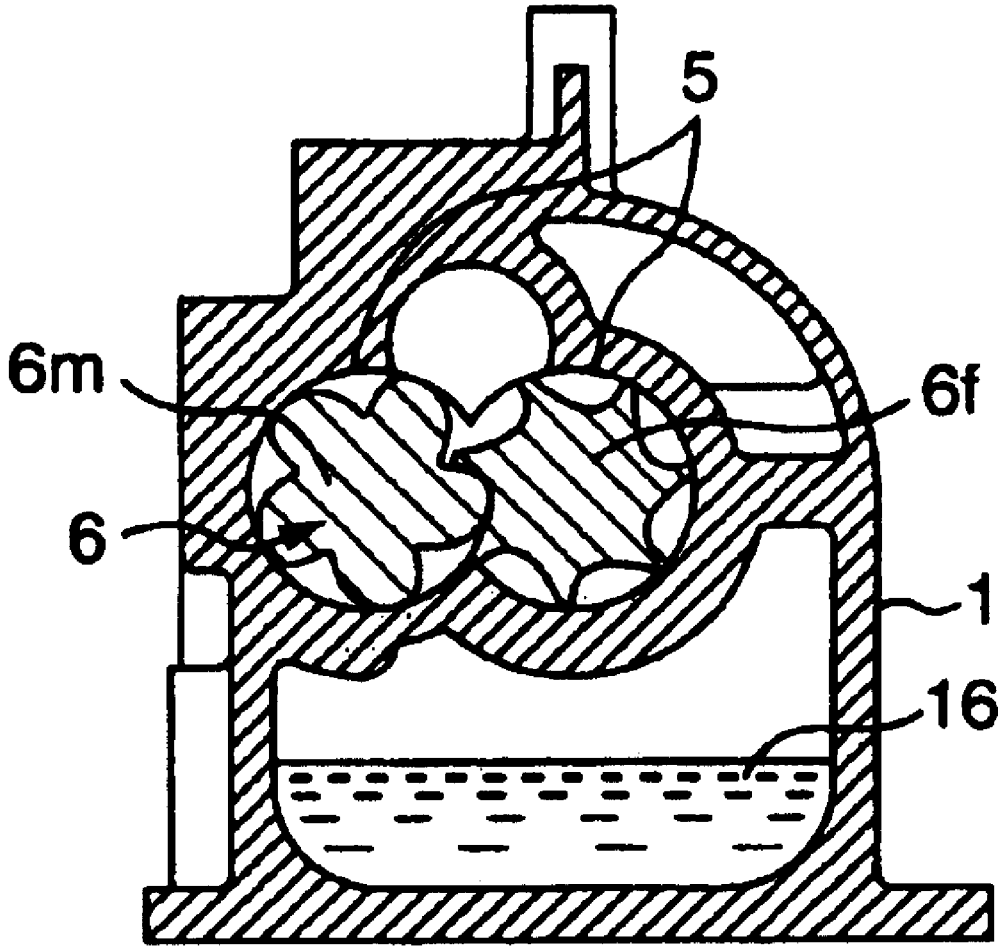
FIG. 2 is a cross sectional view taken along a line A—A of the screw compressor in FIG. 1.

FIGS. 1 and 2 are views of an oil-cooled screw compressor of one embodiment of the present invention, in which the screw compressor includes a casing 1, a motor cover 2 having a suction port 8, and a discharge casing 3, which are connected with one another in a sealed relationship, and further includes a discharge space 4 having a discharge port 14. Within the casing 1, a drive motor 7 is housed and a cylindrical bore 5 and a suction port (not shown) for introducing gas to the cylindrical bore 5 are formed. A pair of male and female screw rotors 6 (the male rotor is designated as **6*m* and the female rotor is designated as 6*f*) engage with each other within the cylindrical bore 5, and is rotatably supported by roller bearings 10, 11 and 12, and by ball bearings 13. A shaft of the female rotor 6*f* is directly connected to the drive motor 7. The roller bearings 12 and the ball bearings 13 are housed in the discharge casing 3 in which a discharge passage (not shown) for gas is formed to communicate the cylindrical bore 5 with the discharge space 4. The discharge casing 3 is fixed to the casing 1 by bolts or other means. Also, at one end of the discharge casing 3, a shield plate 15 is attached to close a bearing chamber 9 in which the roller bearings 12 and the ball bearings 13 are accommodated. In the above described casing 1 and discharge casing 3, an oil supply passage 17 is formed respectively and configured to communicate an oil reservoir 16 provided at a lower part in the discharge space 4** with respective bearing portions.

Then, the following is a description of flow of each of refrigerant gas, and oil.

A low-temperature and low-pressure refrigerant gas, which is sucked through the suction port 8 provided in the motor cover 2, passes through a gas passage (not shown) provided between the drive motor 7 and the casing 1 and through an air gap between a stator and a motor rotor while cooling the motor 7, thereafter the gas is sucked through a suction port formed in the casing 1 into a compression chamber formed by meshing tooth surfaces of male and female screw rotors and the casing. The refrigerant gas sucked into the compression chamber is sealed in the compression chamber in accordance with rotation of the female rotor **6*f* coupled to the motor 7, and then is gradually compressed with reduction in volume of the compression chamber, thereby transformed into a high-temperature and high-pressure refrigerant gas, which passes through the discharge passage formed in the discharge casing 3 and discharged into the discharge space 4. The mixture of oil and gas is separated to the oil and the gas respectively, by an oil separation means (a mesh demister, for example) 18 provided in the discharge space 4, and then the oil is reserved in the oil reservoir 16 and the gas is discharged through the discharge port 14. With respect to loads acting on the male and female screw rotors at the time of compression, radial load is supported by the roller bearings 10, 11 and 12, and thrust load is supported by the ball bearing 13. The oil for lubricating and cooling these bearings is supplied from the high-pressure oil reservoir 16 provided at the lower part in the discharge space 4 through the oil supply passage 17 communicating with each of the bearing parts by utilizing differential pressure, and then the oil is discharged into the discharge space 4** together with compressed gas.

Next, rotation of the male rotor **6*m* and the female rotor 6*f* will be described. It is assumed that the number of teeth of the male rotor is "Zm" and that of the female rotor is "Zf". Presently, as numbers of teeth (Zm, Zf) of male and female rotors of a screw compressor, (5, 6), (5, 7) or (4, 6) are put into practical use. In the present embodiment, any combination which can constitute these tooth profile may be employed. In addition, assuming that rotational speed of a motor is "ω0", the speed is constant in one land area while "ω0" may vary in every land area. Generally in the prior art, a shaft of the male rotor 6*m* is directly connected to the motor, and then the female rotor 6*f* is driven by the male rotor 6*m***. In this case, the rotational speeds of the male and female rotors are respectively as follows:

the rotational speed of the male rotor **6*m*=the rotational speed of the motor=ω0** the rotational speed of the female rotor **6*f*=ω0**×(Zm/Zf)

Because of "Zm"<"Zf" as described above, the rotational speed of the female rotor is lower than "ω0".

On the other hand, in the case that the motor is directly connected to the shaft of the female rotor **6*f* and the male rotor 6*m* is driven by the female rotor 6*f*** as shown in this embodiment, the rotational speeds are respectively formulated as following:

the rotational speed of the female rotor **6*f*=the rotational speed of the motor=ω0** the rotational speed of the male rotor **6*m*=ω0×(Zm/Zf) >ω0**

As indicated above, in case of driving by the female motor **6*f*, both rotational speeds of the male and female rotors 6*m*, 6*f* can be higher than those in case of driving by the male rotor 6*m***, thereby improvement in performance can be achieved because leak from gaps between the rotor and the casing can be relatively decreased.

Further, the rotational speed of the male rotor **6*m* is increased by being driven by the female rotor 6*f***, so that the discharge quantity from the compressor can be also increased. Therefore, in the case of manufacturing compressors having the same discharge quantity, more downsizing can be achieved than that in case of being driven by the male rotor.

Next, the force acting on the rotors at the time of compression will be described. On the rotor, reaction force which is due to compressed gas, and a load which corresponds to transmission torque for rotating a driven shaft by a driving shaft are effected. In the case of the male rotor driving, the transmission torque from the male rotor to the female rotor is approximately 15% of the transmission torque from the motor to the female rotor. On the other hand, in the case of the female rotor driving, the transmission torque is conversely approximately 85% of the transmission torque from the motor to the female rotor. Therefore, it is found that, in the case of the female rotor driving, the load corresponding to the transmission torque between the rotors effects significantly, so that pressure (surface stress) acting on tooth surfaces of the rotors becomes excessive.

Conventionally, nodular graphite cast iron has been frequently used as a material of the rotors, however, it is found that the surface stress in the case of the above described female rotor driving is over the proof stress of the nodular graphite cast iron, resulting in damage on the tooth surfaces such as pitching or scoring. Accordingly, in this embodiment, in order to increase hardness of the surfaces to withstand the excessive surface stress, the tooth surfaces of the rotor are subjected to surface hardening treatment.

Generally, the depth of a layer effected by the surface hardening treatment is several ten microns, and thus, it is difficult to finish it after the treatment. Therefore, previously, the shape before the treatment should be formed with correction by the amounts of changes in dimension due to the treatment. In addition, sulphonitriding or cold nitiriding treatment may be applied, which has relatively small changes in dimension as the surface hardening treatments.

By the sulphonitriding treatment, a soft sulfide layer is formed as an outer layer of an iron nitride layer. Although the layer thickness depends on the treatment time, the kind of steel or the like, it is general that the layer thickness including that of the hard layer ranges between 5 to 25 $\mu$m. Changes in dimension due to the sulphonitriding treatment are smaller than the layer thickness, and friction surfaces between which iron sulfide is intervenient keep smoothness even under high load or high temperature and do not be seized. By applying the sulphonitriding treatment in this way, the outermost sulfide layer flows plastically to increase a contact surface between the friction surfaces, thereby load per unit area can be decreased to improve wear resistance, seizing resistance and galling resistance.

The above described nitriding treatment is also one surface hardening heat treatment, in which nitrogen is dispersed and penetrated through a surface of cast iron to harden the surface of the cast iron. For example, when the treatment is performed in an electric furnace, ammonium gas ($NH_3$) is blown into the electric furnace, and a part of the gas is dissociated into nitrogen (N) and hydrogen (H) when heated to a temperature of 500 to 520° C., thereby the nitrogen can be bonded to elements in iron to make hard nitride. By the nitriding treatment, it is possible to manufacture the rotor having especially superior friction resistance. In addition, since the nitriding treatment offers no expansion and contraction due to changes in structure and can be employed at a low nitriding treatment temperature of 500 to 520° C., bending and deflection of the rotor can be very small to prevent occurrence of cracking or the like.

Further, instead of the above described surface hardening treatments, heat treatment may be employed, so that a rotor which has superior friction resistance can be also manufactured. Austemper treatment is most preferable for the heat treatment. In the austemper treatment, a rotor is made of nodular graphite cast iron, and after the rotor is heated to a temperature of 800 to 900° C. in an anti-oxidation atmosphere for example, the rotor is subjected to hot quenching treatment in a salt bath having a temperature of 200 to 450° C. Then, the rotor is kept in the above described salt bath at a temperature of 200 to 450° C. (preferably 200 to 270° C.) for 5 to 240 minutes (approximately 5 to 30 minutes is preferred if improvement in hardness is desired, and approximately 30 to 90 minutes is preferred if improvement in tensile strength is also desired even if hardness is sacrificed to some extent), and thereafter the rotor is flushed to finish. The austemper treatment are characterized in that toughness, friction resistance and impact resistance of the rotor can be significantly improved, and deflection and changes in dimension due to the heat treatment can be made small.

In case of employing the heat treatment, it is possible to treat the material to the substantially center part thereof, and thus, also to finish it after the heat treatment.

According to the present invention, a female rotor is driven by a motor and a male rotor is driven by the female rotor, and the rotors are composed of a material which is made of cast iron and is subjected to surface hardening treatment or heat treatment including quenching, so that a rotor rotational speed is increased and leak is decreased to achieve improvement in performance, while reliability of rotor tooth surfaces can be improved to provide the advantage of allowing downsizing of the compressor.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A screw compressor comprising:

at least one pair of male and female rotors engaging with each other;

a bearing member supporting the rotors;

a motor for driving the rotors; and a casing member accommodating the rotors, the bearing member and the motor, wherein the motor drives the female rotor, so that the male rotor is driven by the female rotor, and at least one of the male and female rotors is composed of a member which is made of cast iron and is subjected to surface hardening treatment, wherein the surface hardening treatment includes sulphonitriding treatment.

2. The screw compressor according to claim 1, wherein at least one of the male and female rotors is composed of a member made of ductile iron.

3. A screw compressor comprising:

a male rotor;

a female rotor engaging with the male rotor, the number of the teeth of the female rotor being larger than that of the male rotor;

a bearing member supporting the male and female rotors;

a motor for driving the rotors; and a casing member accommodating the male and female rotors, the bearing member and the motor, wherein the motor drives the female rotor, so that the male rotor is driven by the female rotor, and the male and female rotors are composed of a member which is made of cast iron and is subjected to quenching treatment in a liquid, wherein said liquid for the quenching treatment is a salt bath which is at a temperature of 200 to 270° C. and includes salt.

4. The screw compressor according to claim 3, wherein said cast iron is heated to a temperature of 800 to 900° C. in an anti-oxidation atmosphere.

5. The screw compressor according to claim 4, wherein at least one of the male and female rotors is composed of a member made of ductile iron.

6. The screw compressor according to claim 3, wherein at least one of the male and female rotors is composed of a member made of ductile iron.

* * * * *